United States Patent [19]

Sakakino et al.

[11] 4,324,956

[45] Apr. 13, 1982

[54] FLUID-PROOF SLIDE SWITCH

[75] Inventors: Takahiro Sakakino, Nagaokakyo; Hiroyoshi Yamada, Tottori, both of Japan

[73] Assignee: Omron Tateisi Electronics Co., Kyoto, Japan

[21] Appl. No.: 149,920

[22] Filed: May 15, 1980

[30] Foreign Application Priority Data

May 24, 1979 [JP] Japan ..... 54-64758

[51] Int. Cl.[3] ..... H01H 15/00

[52] U.S. Cl. ..... 200/16 R; 200/6 R; 200/6 B; 200/153 LA; 200/302

[58] Field of Search ..... 200/6 R, 6 B, 6 BA, 200/16 R, 16 C, 16 D, 159 B, 302, 5 A, 153 LA, 60

[56] References Cited

U.S. PATENT DOCUMENTS

| | | | |
|---|---|---|---|
| 3,757,060 | 9/1973 | Ianuzzi et al. | 200/302 X |
| 3,800,104 | 3/1974 | Lien et al. | 200/5 A |
| 3,806,673 | 4/1974 | Boulanger | 200/159 B X |
| 3,806,685 | 4/1974 | Seeger, Jr. et al. | 200/159 B X |
| 3,854,018 | 12/1974 | Reynolds et al. | 200/159 B X |
| 3,886,341 | 5/1975 | Forrest | 200/159 B X |
| 3,898,421 | 8/1975 | Suzumura | 200/5 A |
| 3,909,564 | 9/1975 | Scheingold et al. | 200/5 A X |
| 3,917,921 | 11/1975 | Jakubauskas | 200/16 R X |
| 3,932,722 | 1/1976 | Obata et al. | 200/5 A X |
| 3,974,346 | 8/1976 | Keprda | 200/16 D X |
| 4,092,504 | 5/1978 | Kotaka | 200/16 D |
| 4,114,000 | 9/1978 | Feder | 200/16 R |
| 4,119,823 | 10/1978 | Matsueda et al. | 200/16 R X |
| 4,184,321 | 1/1980 | Tarusawa | 200/302 X |

FOREIGN PATENT DOCUMENTS

| | | | |
|---|---|---|---|
| 848538 | 9/1960 | United Kingdom | 200/302 |
| 2041656 | 9/1980 | United Kingdom | 200/153 LA |

*Primary Examiner*—James R. Scott

*Attorney, Agent, or Firm*—Wegner & Bretschneider

[57] ABSTRACT

There is disclosed a fluid-proof slide switch having at least a pair of contacts contained in a housing, and a horizontally movable slider for electrical connection or disconnection of the contacts.

A flexible sealing member is placed between the slider and contacts to form a fluid-proof chamber containing the contacts. The sealing member is deformed in response to the movement of said slider to make the electrical connection or disconnection.

10 Claims, 11 Drawing Figures

FLUID-PROOF SLIDE SWITCH

BACKGROUND OF THE INVENTION

This invention relates to a slide switch and, more particularly, to a DIP type slide switch having at least a pair of contacts contained in a housing, and a horizontally movable slider for electrical connection or disconnection of the contacts.

Well known slide switches have a housing member and a cover member attached thereto and having an aperture through which a knob of the slider projects upwardly for driving the slider manually in a horizontal direction. Such slide switches have the disadvantage that the contacts contained in the housing are often contaminated with dust, etc. which may come into the housing through the aperture, causing a malfunction of the switches. A specific disadvantage is found in the assembling of an electric device comprising a printed circuit board and a plurality of parts including the slide switch. Thus, after the above-mentioned parts are affixed to the printed circuit board by automatic soldering, the semi-assembly cannot be dipped into water for washing the soldering paste out, since the slide switch will be affected by the water. For this reason, the parts other than the slide switch are first attached to the pc board by automatic soldering and, after this preassembly is washed in water, the slide switch is attached to the pc board by manual soldering, followed by washing the manually soldered part with a water nozzle. This procedure is time-consuming and costly.

It is an object of this invention to provide a fluid-proof slide switch. It is another object of this invention to provide a fluid-proof switch which is simple in construction and low in manufacturing cost. According to this invention, a flexible sealing member of an insulating material is placed between the slider and the contacts to form a fluid-proof chamber containing the contacts. Other objects and the nature of this invention will be apparent from the following detailed description.

DETAILED DESCRIPTION OF THE PREFERRED EMBODIMENTS

Figure 1:
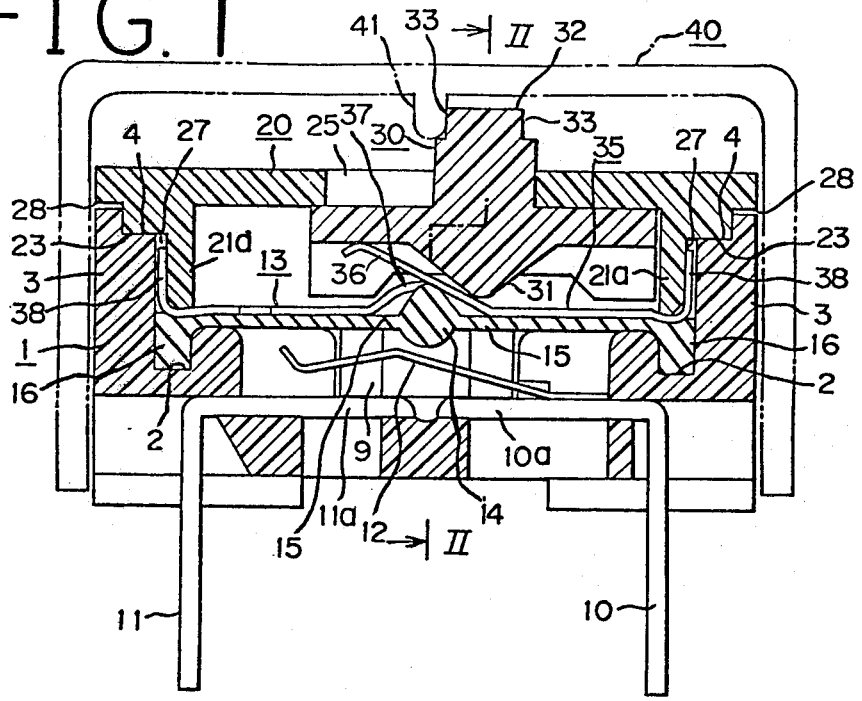
FIG. 1 is a sectional view showing the slide switch according to this invention.

Referring to FIGS. 1 through 5, a fluid-proof slide switch according to this invention comprises a housing member 1, a plurality of pairs of terminals 10 and 11 having contact portions 10*a* and 11*a*, respectively, a flexible sealing member 13 of an insulating material, a cover member 20, a plurality of sliders 30, and an intermediate actuating member 35.

Figure 3:
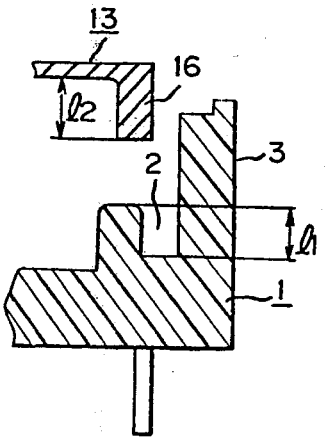
FIG. 3 is a schematic sectional view showing the relation between the housing and sealing member shown in FIG. 1.
Figure 4:
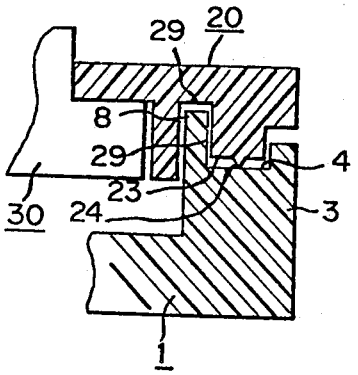
FIG. 4 is a schematic sectional view showing the relation between the housing and cover member shown in FIG. 1.

The housing 1 has a U configuration in sectional view and is made of thermoplastic resin. A plurality of terminals 10 and 11 are partially embedded into housing 1 by insert molding in juxtaposed relation, with contact portions 10*a* and 11*a* confronting with each other on the bottom of the housing 1. A movable contact 12 is a resilient metal leaf welded to the contact portion 10*a* at one end, with the free end thereof being normally extending upwardly. The contact 12 and contact portion 10*a* may be a one-piece member. A plurality of sliders 30 are positioned between housing 1 and cover member 20 and are horizontally slidable. A slider 30 has a downward projection 31 and an upward projection 32 which projects through an aperture 25 of cover member 20. An intermediate actuating member 35, more clearly shown in FIG. 8, has a plurality of movable tips 36, side portions 38, and barrier portions 37. The intermediate actuating member may be formed by stamping out from a metal plate. A free end of each tip 36 extends upwardly and is engageable with the projection 31 of slider 30. The sealing member 13 of insulating material, for example a rubber sheet, has a thin sheet portion 15 and a plurality of protrusions 14 projecting from the sheet portion 15 in upward and downward directions. The sealing member 13 has a peripheral projection 16 which is inserted into a groove 2 of housing 1. The sealing member 13 is sandwitched at its peripheral portion between the housing 1 and peripheral walls 21*a* and 21*b* of cover member 20 thereby to separate the contact portions 10*a*, 11*a* and movable contact 12 from slider 30 and make a sealed chamber containing the contact portions 10*a*, 11*a* and movable contact 12. As shown in FIG. 2, each pair of contact portions 10*a* and 11*a* is contained in an individual chamber 9 separated from other chambers by walls 17 of sealing member 13. As shown in FIG. 3, the height L2 of projection 16 of sealing member 13 is slightly greater than the depth L1 of groove 2 of housing 1 so that, when a pressing force is applied, the projection 16 is deformed in the groove 2, causing more tight fitting. The cover member 20 of molded resin has peripheral walls 21*a* and 21*b* and a peripheral step portion 23, the peripheral step portion 23 having a circular projection 24 for ultrasonic welding. The cover member 20 may, in assembling, be first temporarily fixed to housing 1 by engaging a projection 22 at the side wall 21*b* to a recess 5, then the cover member 20 is affixed to the housing 1 by ultrasonic welding between the step portion 23 and the upper surface 4 of the housing. A small amount of the resin will melt in this process but is retained in gaps 26 through 28. FIG. 4 shows an improved housing 1 which is provided with a wall 8 for precluding an outflow of molten resin from said gaps. A cap member 40 made of transparent resin has a longitudinal projection 41 which projects from the inner side of its upper wall, as shown in FIG. 1, the projection 41 being engageable with knobs 33 of sliders 30 to keep the sliders 30 in selected positions after the slide switch is assembled in an electrical device.

Figure 2:
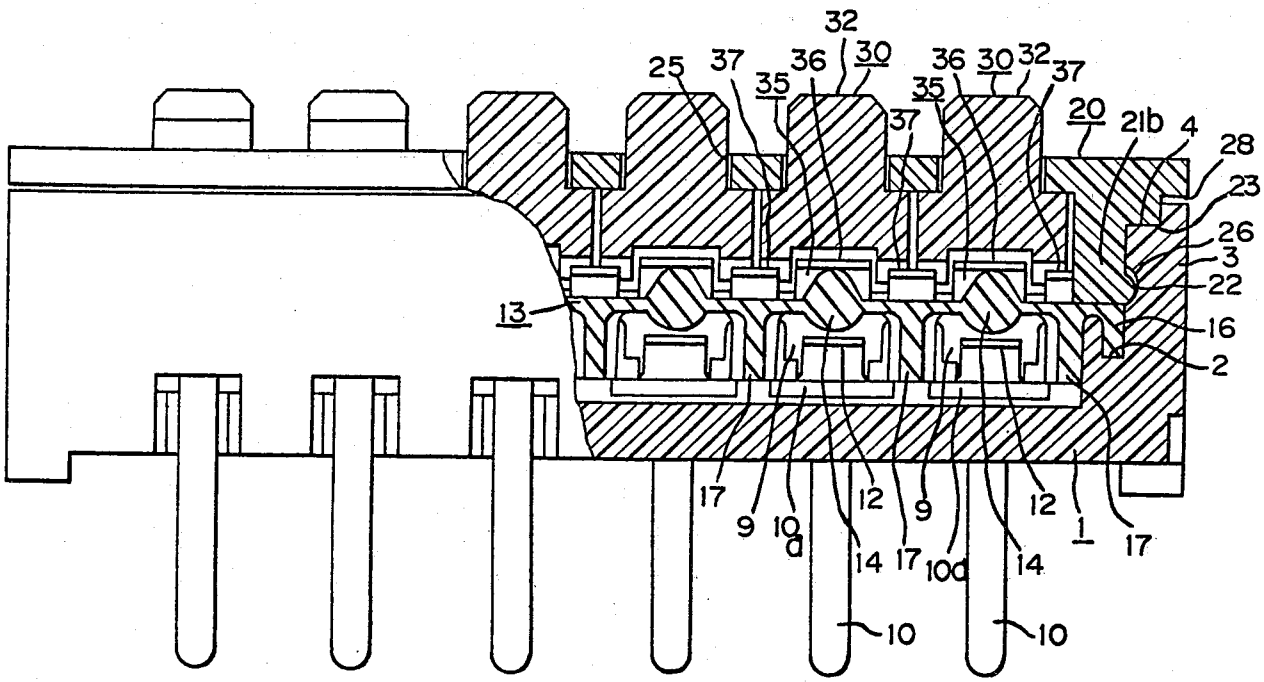
FIG. 2 is a sectional view taken along the line II—II of FIG. 1.
Figure 5:
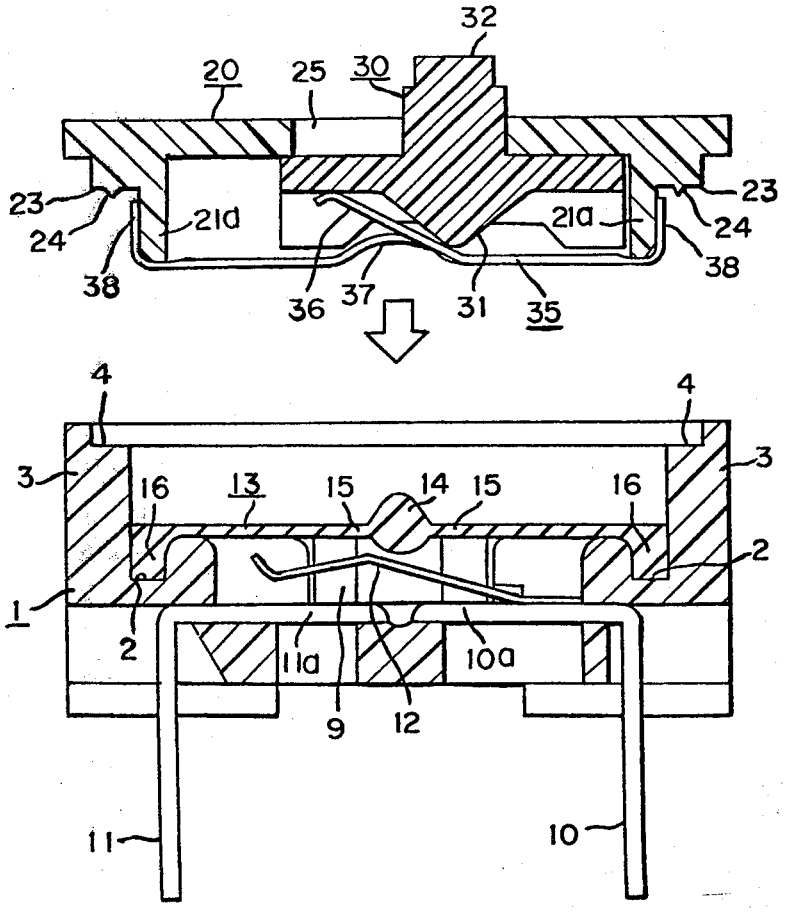
FIG. 5 is a sectional view of the slide switch in its assembling process.

The fluid-proof slide switch described above operates as follows:

When a slider 30 is positioned at the right side as in FIG. 1, the projection 31 of slider 30 does not engage or press downwardly the movable tip 26. In this condition, the tip 36, protrusion 14, and movable contact 12 are all in normal position, and terminals 10 and 11 are not electrically connected. When the slider 30 is moved to the left side, the projection 31 presses downwardly the movable contact 12 through tip 36 and protrusion 14 to make an electrical connection between terminals 10 and 11. When the slider is operated either way, the projection 31 must ride over the barrier portion 37 and the resulting resistance enables the operator of the switch positively to confirm the switching operation. The actuating member 35 is, essentially speaking, not necessary in the slide switch of this invention, but adds to the smooth movement of slider 30, and helps protect the contacts against abrasion and fatigue.

Figure 6:
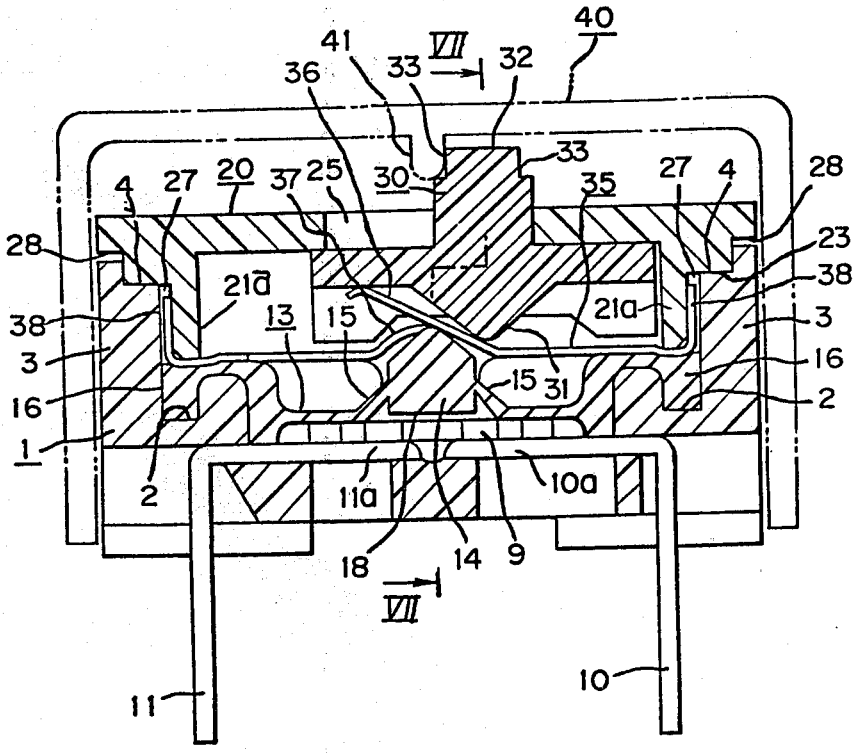
FIG. 6 is a sectional view of the slide switch according to another embodiment of this invention.
Figure 7:
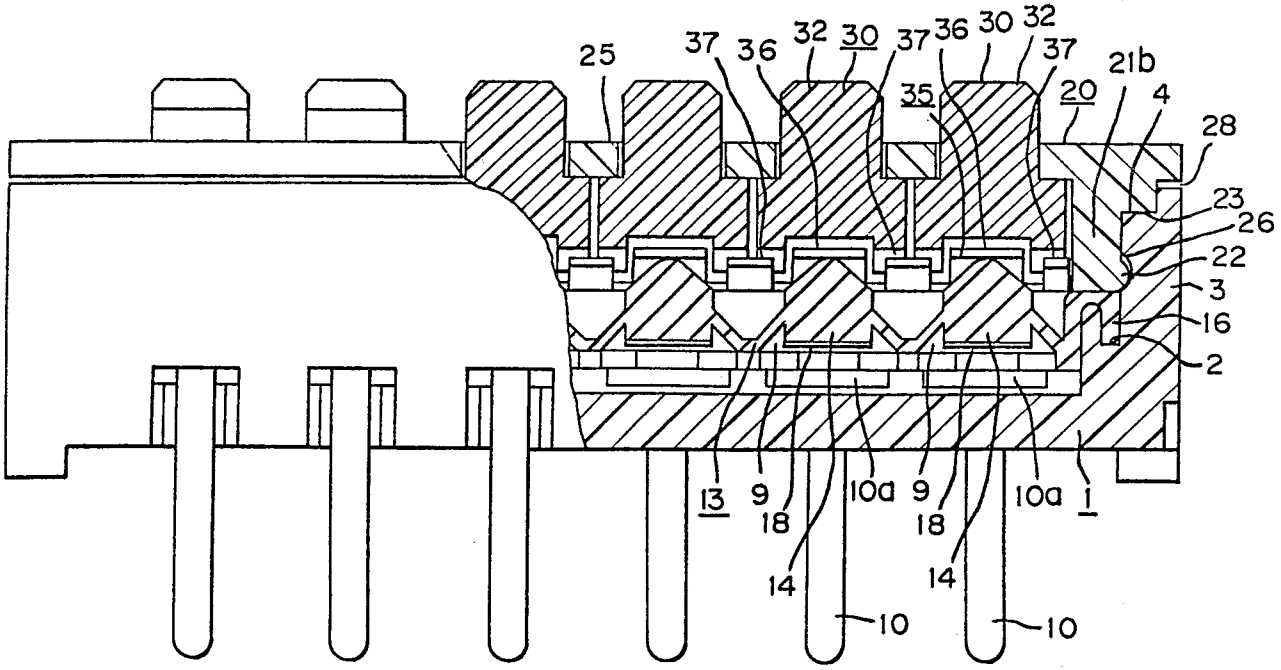
FIG. 7 is a sectional view taken along the line VII—VII of FIG. 6.
Figure 8:
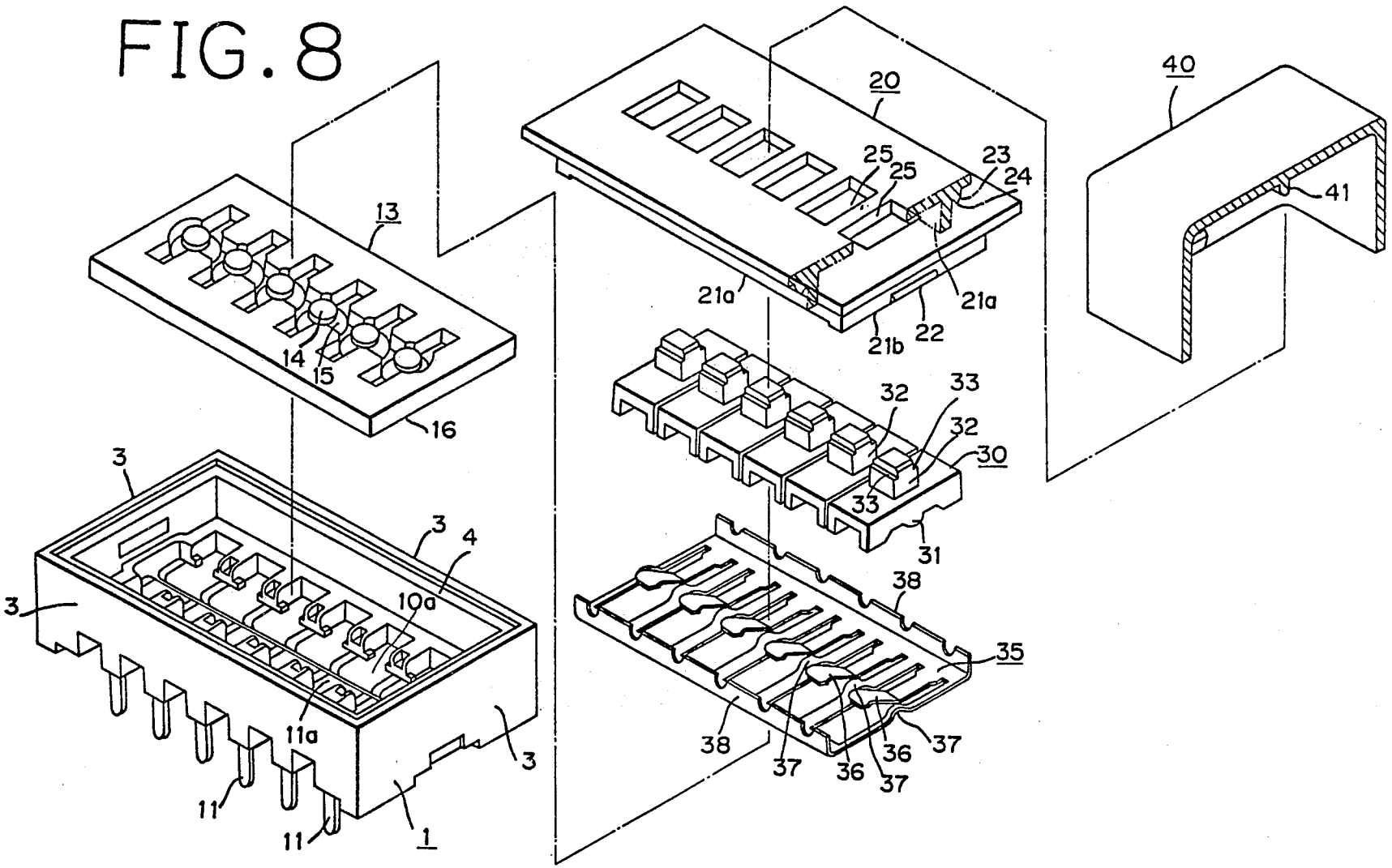
FIG. 8 is an exploded perspective view of the slide switch shown in FIG. 6.

Referring now to FIGS. 6 to 8 which illustrate another embodiment of this invention, there is shown a modified sealing member 13 having a plurality of protrusions 14. A movable contact member 18, instead of the metal leaf contact 12 shown in FIGS. 1 to 5, is attached to each protrusion 14 at its under surface. The contact member 18 is a stamped thin member consisting of, for example, a conductive layer of resin and a metal layer plated thereto, and is combined to the sealing member 13 at insert molding. Such contact member 18 may be formed in any other suitable manner, for example by sputtering.

Figure 9:
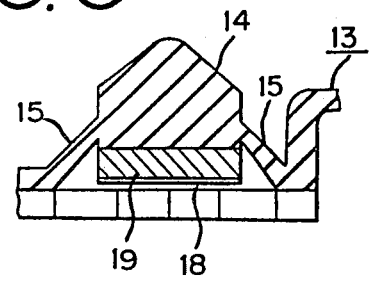
FIGS. 9 and 10, respectively, are sectional views showing variations of the movable contact shown in FIG. 6.

FIG. 9 shows another variation of the contact member, which consists of an electrically conductive rubber member 19 and a metal layer 18 sputtered thereto. The metal layer 18 may have a plating metal layer.

Figure 10:
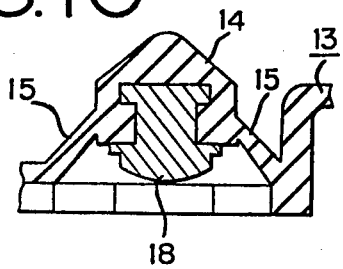

FIG. 10 shows another variation of the contact member, which consists of a contact member 18 of button-like configuration having a plated layer.

Figure 11:
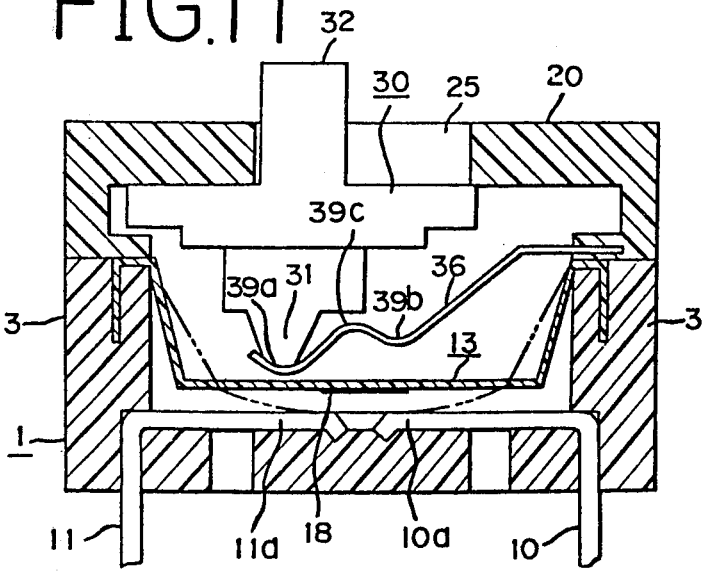
FIG. 11 is a sectional view of the slide switch according to another embodiment of this invention.

FIG. 11 shows another embodiment of this invention. In this embodiment, the sealing member 13 is made of a resin film and provided with a contact member 18 at its under surface. Any protrusion is not provided on the sealing member 13. The contact member 18 may be formed on the sealing member 13 by sputtering, plating, or any other suitable method. The member 36 is formed in a W configuration and, normally, is engaged with protrusion 31 at a concave 39*a*.

When the slider 30 is positioned at the left side, the sealing member 13 is not deformed by the slider 30 through the actuating member 36 so that the contact member 18 does not contact the contact portions 10*a* and 11*a*, the terminals 10 and 11 being not electrically connected. When the slider 30 is moved to the right side, the protrusion 31 presses the sealing member 13 through the actuating member 36, causing electrical connection between terminals 10 and 11. When the slider 30 moves over a convex portion 39*c*, the operator who pushes the knob 32 can feel the switching action.

What is claimed is:

1. A fluid-proof slide switch comprising:

a box-like housing of insulating material;

a cover of insulating material attached to said housing and having a plurality of apertures;

a plurality of sliders positioned beneath of said cover, each slider having a knob projecting upwardly through said aperture and being horizontally movable;

a plurality of intermediate actuating leaf spring members positioned correspondingly to said sliders and fixed with respect to said housing and said cover;

a plurality of pairs of metal terminals aligned in said housing correspondingly with said actuating leaf spring members, one terminal in each of said pairs of said terminals having a movable member; and a deformable sealing member of insulating material disposed between said actuating members and said terminals which, taken together with said housing, forms a fluid-proof chamber containing said terminals so that an electrical connection or disconnection of each of said pairs of terminals is accomplished individually upon the application of a downward force from the corresponding intermediate actuating leaf spring members to said sealing member in response to the horizontal movement of said corresponding sliders.

2. The slide switch of claim 1, wherein said sealing member has a plurality of upward projections engageable with corresponding sliders whereby a part of said member is movable in a vertical direction in response to the horizontal movement of one of said sliders.

3. A slide switch according to claim 2, wherein said sealing member has a plurality of downward projections which accomplish said electrical connection or disconnection when one of said sliders imparts a downward force to said sealing member.

4. A slide switch according to claim 3, wherein said sealing member is made of rubber.

5. A slide switch according to claim 2, wherein one of each pair of said terminals is made of leaf spring metal.

6. A slide switch according to claim 2, wherein said sealing member is provided with at least one electrically conductive member which accomplishes said electrical connection or disconnection upon receiving a downward force from one of said sliders.

7. A slide switch according to claim 2, wherein said sealing member is attached at its periphery to said housing.

8. A slide switch according to claim 7, wherein said sealing member has a peripheral projection and said housing has a peripheral groove, said peripheral projection being inserted into said peripheral groove.

9. A slide switch according to claim 2, wherein the periphery of said sealing member is sandwiched between said cover and said housing.

10. The slide switch of claim 1, wherein said actuating members are leaf spring member fabricated out a single sheet of conductive resilient material.

* * * * *